US009103350B2

(12) United States Patent
Wang

(10) Patent No.: US 9,103,350 B2
(45) Date of Patent: Aug. 11, 2015

(54) CEILING FAN BLADE

(75) Inventor: Cliff Wang, Taichung (TW)

(73) Assignee: Air Cool Industrial Co., Ltd., Tiachung (TW)

( * ) Notice: Subject to any disclaimer, the term of this patent is extended or adjusted under 35 U.S.C. 154(b) by 536 days.

(21) Appl. No.: 13/584,394

(22) Filed: Aug. 13, 2012

(65) Prior Publication Data

US 2014/0044548 A1 Feb. 13, 2014

(51) Int. Cl.
*F04D 29/34* (2006.01)
*F04D 25/08* (2006.01)
*F04D 29/38* (2006.01)

(52) U.S. Cl.
CPC ..... *F04D 29/34* (2013.01); *F04D 25/088* (2013.01); *F04D 29/388* (2013.01)

(58) Field of Classification Search
CPC ..... F04D 29/34; F04D 25/088
See application file for complete search history.

(56) References Cited

U.S. PATENT DOCUMENTS 7,402,025 B2 * 7/2008 Wang ..... 416/62

* cited by examiner

*Primary Examiner* — Edward Look
*Assistant Examiner* — Cameron Corday
(74) *Attorney, Agent, or Firm* — Wang Law Firm, Inc.; Li K. Wang; Stephen Hsu

(57) ABSTRACT

A ceiling fan blade includes a blade having at least one locking plate embedded in the interior. The locking plate is provided thereon with at least one locking base protruding out of the reverse side of the blade. A blade holder to be locked with the blade is bored with a locking hole at a location corresponding with the locking base for the locking base to be inserted therein. The blade is firmly locked on the blade holder via at least one locking member. By so designing, there is not any locking member on the downward obverse side of a ceiling fan blade, able to maintain a smooth and pretty external appearance of the ceiling fan blade.

4 Claims, 5 Drawing Sheets

CEILING FAN BLADE

BACKGROUND OF THE INVENTION

1. Field of the Invention

This invention relates to a ceiling fan blade.

2. Description of the Prior Art

A convention ceiling fan generally includes a motor 1, a plurality of blades 2 and a plurality of blade holders 3 that are secured on the rotary shaft of the motor 1 for firmly combining the blades 2 and the motor 1 together. However, during assembly of the conventional ceiling fan, at least one locking member 4 must be used for fixing the blade 2 and the blade holder 3 together. After being locked, the locking member 4 will be exposed to the downward obverse side of the blade 2 to spoil the pretty external looks of the conventional ceiling fan. Therefore, the defect of external looks of the conventional ceiling fan has to be improved.

Adhering to the spirit of endeavoring to do everything better and having much experience in researching and manufacturing all sorts of ceiling fans and related parts, the inventor of this invention offers a newly-designed ceiling fan blade for ameliorating the conventional ceiling fan.

SUMMARY OF THE INVENTION

The objective of this invention is to offer a ceiling fan blade having not any locking member on the downward obverse side of the blade, able to maintain a smooth and pretty external appearance of the ceiling fan blade.

The ceiling fan blade in the present invention includes a blade having one side facing downward defined to be an obverse side and another side facing upward defined to be a reverse side. At least one locking plate is fully embedded in the interior of the blade and provided thereon with at least one locking base protruding out of the reverse side of the blade. A blade holder for locking and connecting the blade is bored with a locking hole at a location corresponding with the locking base for the locking base to be inserted therein. The blade is firmly fixed on the blade holder via at least one locking member that is inserted through the locking hole and locked on the locking base.

The ceiling fan blade of this invention is to have the locking base of the locking plate protruding out of the reverse side of the blade for securing the blade on the blade holder by the locking member. Thus, there is not any locking member on the downward obverse side of the ceiling fan blade, enabling the ceiling fan blade to maintain a smooth and pretty external appearance.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
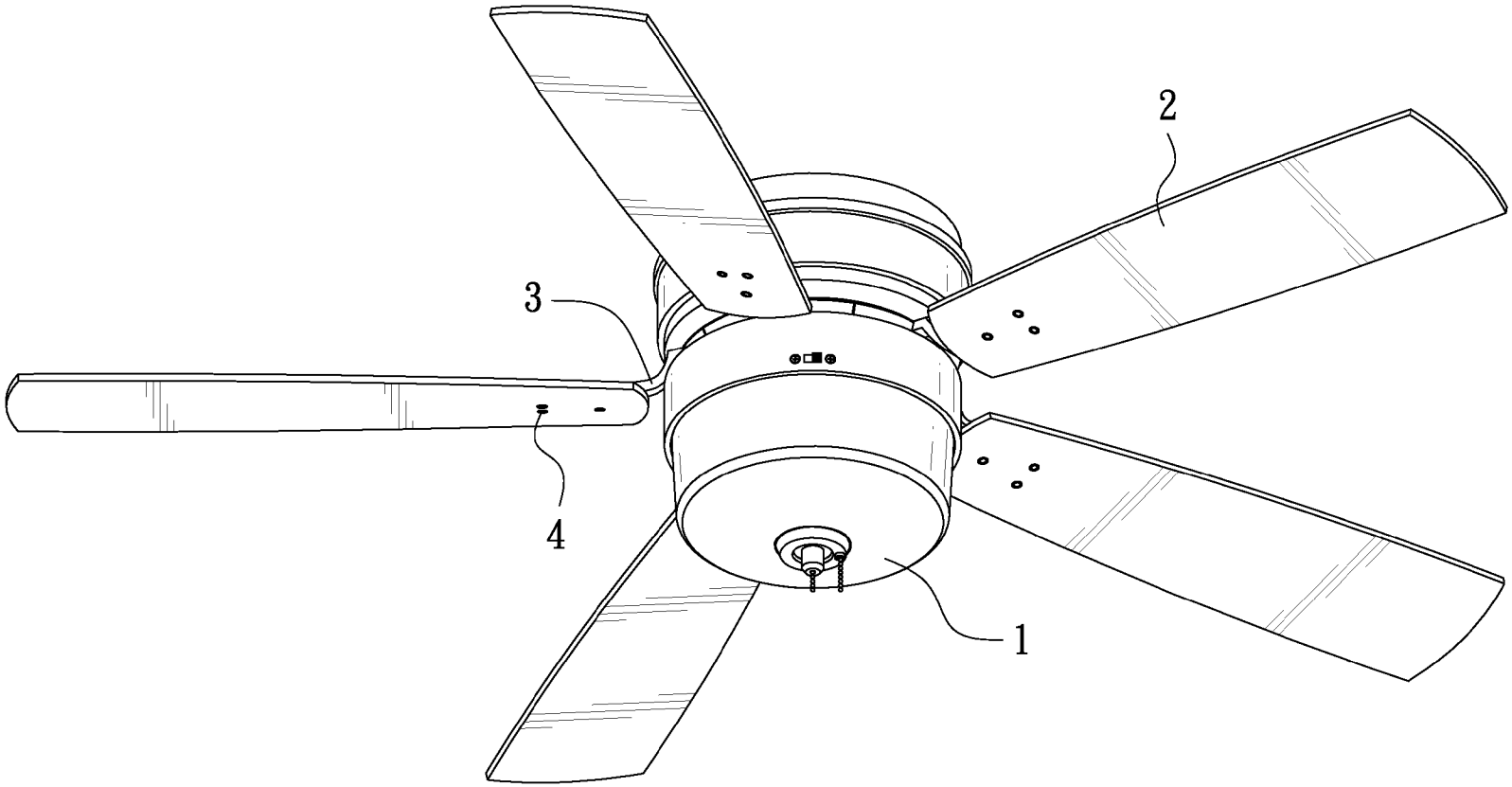
FIG. 1 PRIOR ART
FIG. 1 is a perspective view of a conventional ceiling fan.
Figure 2:
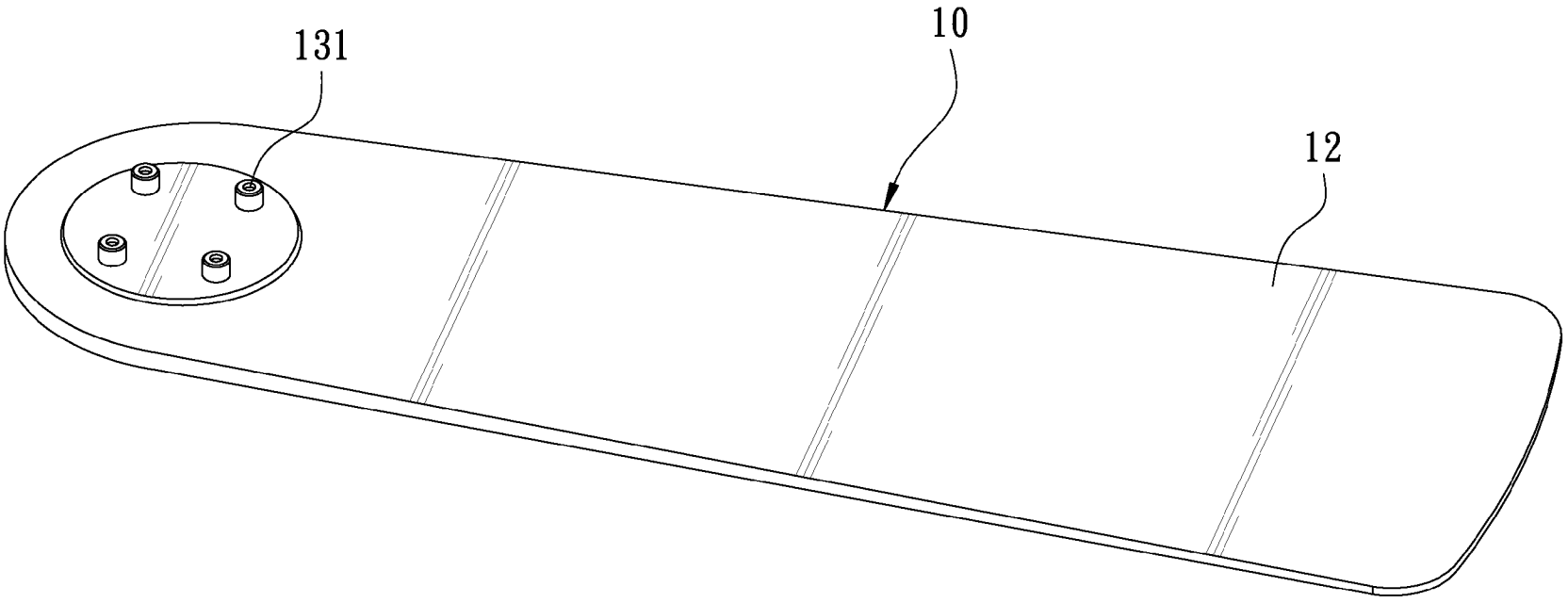
FIG. 2 is a perspective view of a ceiling fan blade in the present invention.
Figure 3:
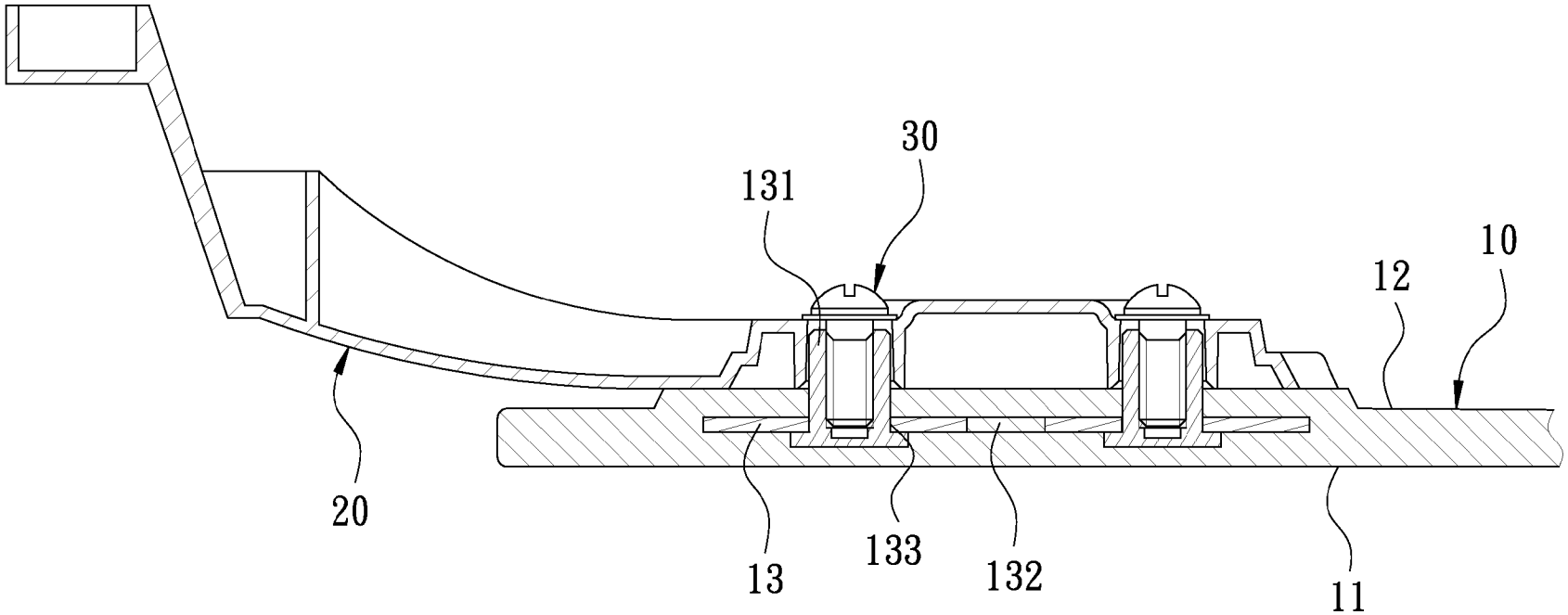
FIG. 3 is a cross-sectional view of the ceiling fan blade in the present invention.
Figure 4:
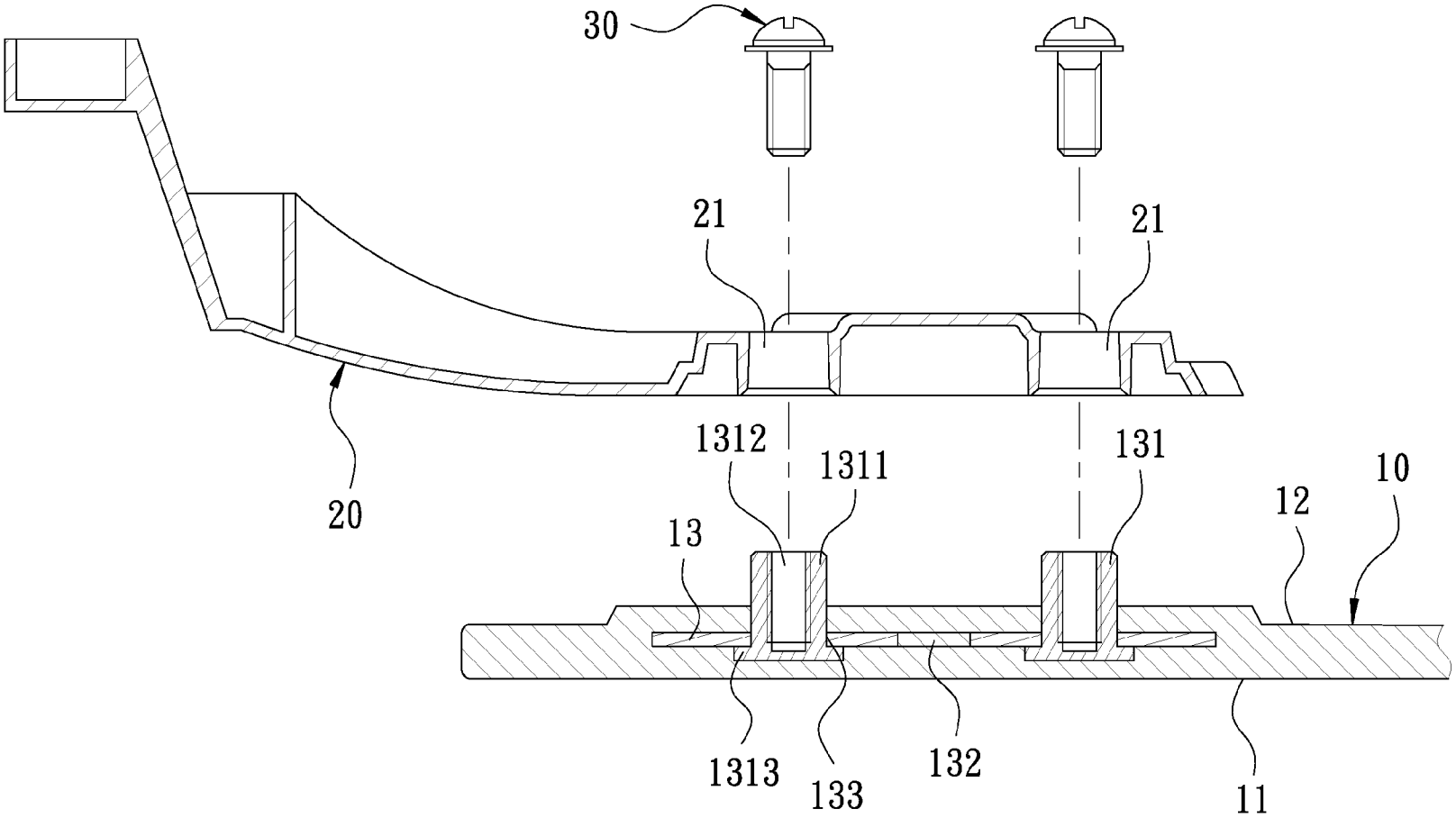
FIG. 4 is an exploded cross-sectional view of the ceiling fan blade in the present invention.

A preferred embodiment of a ceiling fan blade in the present invention, as shown in FIGS. 2, 3 and 4, includes a blade 10, a blade holder 20 and four locking members 30 combined together.

The blade 10 has one side facing downward defined to be an obverse side 11 and another side facing upward defined to be a reverse side 12, and a locking plate 13 is embedded in the interior of the blade 10 and bored with a longitudinal through hole 132 so that when the locking plate 13 is embedded in the blade 10 during the blade 10 is being shaped, the space in the through hole 132 can be filled up for reinforcing the combined strength of the locking plate 13 and the blade 10. The locking plate 13 is provided thereon with four locking bases 131, which are respectively a stud 1311 having a bottom side annularly formed with a flange 1313. The locking plate 13 is further disposed with four through holes 133 for the four locking bases 131 to be respectively inserted and fixed therein, and thus the locking bases 131 can be firmly combined with the locking plate 13 with great strength by mutual restriction and stoppage of the flange 1313 and the locking plate 13. In addition, the studs 1311 are respectively and axially bored with a threaded hole 1312 for a locking member 30 to engage with so that the blade 10 may be firmly secured on the blade holder 20. The locking bases 131 on the locking plate 13 protrude out of the reverse side 12 of the blade 10, while the locking plate 13 fully embedded in the interior of the blade 10 is further formed with a comparatively thick portion at a location corresponding with the locking plate 13.

The blade holder 20 to be locked and connected with the blade 10 is provided with four locking holes 21 at locations respectively corresponding with the locking bases 131 for the locking bases 131 to be respectively inserted therein.

The four locking members 30, which are bolts in the preferred embodiment of this invention, are respectively inserted through the locking holes 21 of the blade holder 20 and screwed in the threaded holes 1312 of the studs 1311 and then locked on the locking bases 131 for firmly securing the blade 10 on the blade holder 20. This is merely a preferred embodiment but actually it is not confined to the mode of the preferred embodiment of this invention.

Referring to FIGS. 3 and 4, the feature of this invention is to have the locking plate 13 completely embedded in the interior of the blade 10 and the locking bases 131 on the locking plate 13, which protrude out of the reverse side 12 of the blade 10, respectively and correspondingly inserted in the locking holes 21 of the blade holder 20 and then have the locking members 30 respectively inserted through the locking holes 21 and threadably locked with the locking bases 131 to firmly secure the blade 10 on the blade holder 20. In the preferred embodiment of this invention, the locking members are bolts and the locking bases 131 are the studs 1311 respectively and axially bored with the threaded hole 1312, and the bolts are respectively inserted through the locking holes 21 of the blade holder 20 and threadably locked with the threaded holes 1312 of the studs 1311, which are respectively inserted in the locking holes 21, to secure the blade 10 on the blade holder 20.

Figure 5:
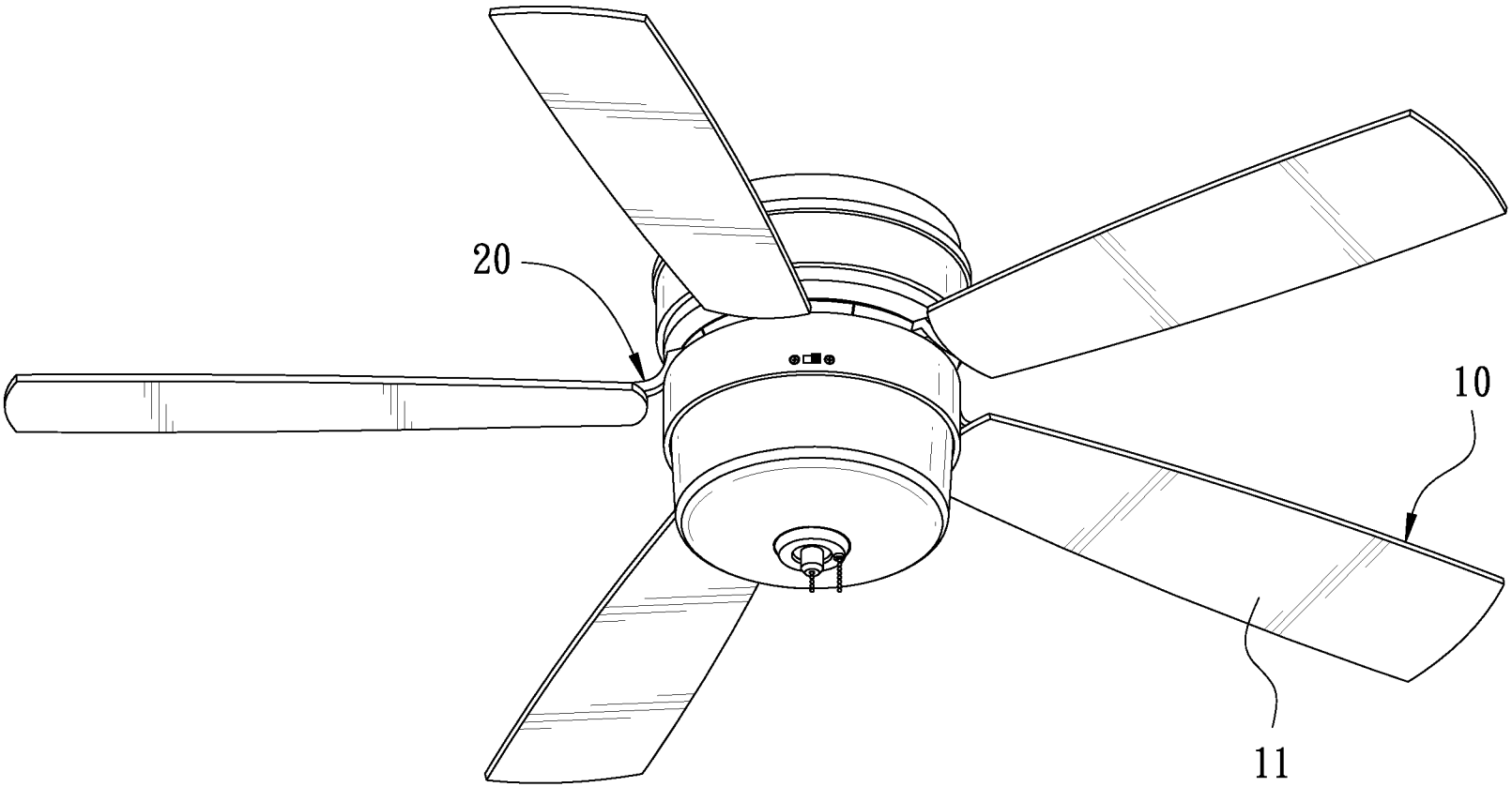
FIG. 5 is a perspective view of the ceiling fan in the present invention.

Specifically, referring to FIGS. 3, 4 and 5, by having the locking bases 131 at the reverse side 12 of the blade 10 respectively inserted in the locking holes 21 of the blade holder 20 and firmly locked therein by the locking members 30, the blade 10 can be firmly fixed on the blade holder 20 and there is not any locking member on the downward obverse side of a ceiling fan blade. Thus, the ceiling fan blade can maintain a smooth and pretty external appearance.

While the preferred embodiment of the invention has been described above, it will be recognized and understood that various modifications may be made therein and the appended claims are intended to cover all such modifications that may fall within the spirit and scope of the invention.

What is claimed is:

1. A ceiling fan blade comprising:

a blade, said blade having one side facing downward defined to be an obverse side and another side facing upward defined to be a reverse side, at least one locking plate embedded in said blade, said locking plate provided thereon with at least one locking base, said locking base protruding out of said reverse side of said blade, said locking plate is formed with at least one through hole for said locking base to be inserted and fixed therein;

a blade holder locked with said blade, said blade holder bored with a locking hole at a location corresponding with said locking base for said locking base to be inserted therein; and at least one locking member inserted through said locking hole and firmly locked on said locking base to secure said blade on said blade holder.

2. The ceiling fan blade as claimed in claim 1, wherein said locking base is a stud axially bored with a threaded hole, and said locking member is a bolt to be screwed with said threaded hole.

3. The ceiling fan blade as claimed in claim 2, wherein said stud has a bottom side annularly disposed with a flange to secure said locking plate to said blade holder.

4. The ceiling fan blade as claimed in claim 1, wherein said locking plate is bored with at least one insert hole longitudinally passing through a top side and a bottom side of said locking plate.

* * * * *